US008199962B2

(12) United States Patent
Maeda

(10) Patent No.: US 8,199,962 B2
(45) Date of Patent: Jun. 12, 2012

(54) LOUDSPEAKER DIAPHRAGM AND LOUDSPEAKER USING THE SAME

(75) Inventor: Tatsuya Maeda, Neyagawa (JP)

(73) Assignee: Onkyo Corporation, Osaka (JP)

( * ) Notice: Subject to any disclaimer, the term of this patent is extended or adjusted under 35 U.S.C. 154(b) by 903 days.

(21) Appl. No.: 12/196,383

(22) Filed: Aug. 22, 2008

(65) Prior Publication Data

US 2009/0060251 A1 Mar. 5, 2009

(30) Foreign Application Priority Data

Aug. 29, 2007 (JP) ..... 2007-222011

(51) Int. Cl.
*H04R 9/06* (2006.01)

(52) U.S. Cl. ..... 381/398; 381/424; 181/173

(58) Field of Classification Search ..... 381/398, 381/423, 424; 181/173
See application file for complete search history.

(56) References Cited

U.S. PATENT DOCUMENTS

| | | | | |
|---|---|---|---|---|
| 6,757,404 | B2 * | 6/2004 | Takewa et al. | 381/430 |
| 6,957,714 | B2 * | 10/2005 | Takahashi et al. | 181/171 |
| 7,306,073 | B2 | 12/2007 | Frasl | |
| 2006/0070796 | A1 * | 4/2006 | Frasl | 181/173 |
| 2006/0153420 | A1 | 7/2006 | Takase et al. | |
| 2006/0239494 | A1 | 10/2006 | Kimura et al. | |
| 2007/0047757 | A1 * | 3/2007 | Yang et al. | 381/423 |
| 2009/0296978 | A1 * | 12/2009 | Kamimura et al. | 381/412 |

FOREIGN PATENT DOCUMENTS

| | | |
|---|---|---|
| JP | 50-89330 | 7/1975 |
| JP | 51-90948 | 7/1976 |
| JP | 08-140183 | 5/1996 |
| JP | 09-135491 | 5/1997 |
| JP | 2005-184588 | 7/2005 |
| JP | 2006-287418 | 10/2006 |
| WO | 2004/047487 | 6/2004 |

* cited by examiner

*Primary Examiner* — Alexander Ghyka
*Assistant Examiner* — Stanetta Isaac
(74) *Attorney, Agent, or Firm* — Renner, Otto, Boisselle & Sklar, LLP

(57) ABSTRACT

A loudspeaker diaphragm having a small overall height dimension, in which a dome portion has a sufficient rigidity and which is capable of realizing a stable loudspeaker operation, wherein the loudspeaker diaphragm can realize a desirable sound reproduction without noise, or the like, with a frequency response that is flat over a wide range. In the loudspeaker diaphragm of the present invention, the dome portion includes a concave dome portion formed at a center thereof, a convex dome portion along an outer periphery of the concave dome portion, a plurality of depressed ribs each extending in a radial direction across a boundary between the concave dome portion and the convex dome portion, a voice coil attachment portion along an outer periphery of the convex dome portion, and a plurality of protruding ribs extending in the radial direction across a boundary between the convex dome portion and the voice coil attachment portion, wherein each protruding rib is spaced apart in a circumferential direction from two adjacent depressed ribs.

5 Claims, 4 Drawing Sheets

(a)

(b)

(a)

(b) Sec. O−A

LOUDSPEAKER DIAPHRAGM AND LOUDSPEAKER USING THE SAME

BACKGROUND OF THE INVENTION

1. Field of the Invention

The present invention relates to a loudspeaker diaphragm for use in a loudspeaker for reproducing sound in a portable electronic device such as a portable telephone or a portable game device, and a loudspeaker using such a loudspeaker diaphragm.

2. Description of the Related Art

Some small loudspeakers employ a loudspeaker diaphragm being a film member of a resin such as PEI (polyetherimide), wherein the film member is a single-piece member including a dome portion and an edge portion, the edge portion extending along the outer periphery of the dome portion. Where such a loudspeaker is an electrodynamic loudspeaker, a voice coil to which an audio signal current is supplied may be attached to the junction between the dome portion and the edge portion of the loudspeaker diaphragm on the rear surface of the loudspeaker diaphragm. The outer periphery of the edge portion of the loudspeaker diaphragm is fixed to a frame that is coupled to a small and light-weighted magnetic circuit, with the voice coil being disposed in a magnetic gap of the magnetic circuit. The shape of a loudspeaker diaphragm of a small loudspeaker influences the quality of the sound reproduced from the small loudspeaker and the overall dimensions of the small loudspeaker.

In some conventional small loudspeakers for use in portable game devices, or the like, not only the overall height of the magnetic circuit, but also that of the loudspeaker diaphragm, are reduced in an attempt to further reduce the size, the thickness and the weight. For example, Japanese Laid-Open Patent Publication No. 2005-184588 discloses a loudspeaker having a loudspeaker diaphragm whose cross section inside the voice coil has a generally dome-like shape, wherein a depression is formed in a portion of the generally dome-like shape in order to reduce the unwanted resonance and to reduce the overall height dimension of the loudspeaker diaphragm. Japanese Laid-Open Patent Publication No. 8-140183 discloses a diaphragm including a main dome portion and a sub-dome portion being continuous with, and extending around, the main dome portion, wherein the sub-dome portion includes a number of radial grooves extending so that the proximal end thereof reaches the boundary between the main dome portion and the sub-dome portion, in order to flatten the relative sensitivity over the range of 4 to 8 kHz.

Japanese Laid-Open Patent Publication No. 9-135491 discloses a loudspeaker having a diaphragm, including a dome portion, an edge portion, and a flat portion at the boundary between the dome portion and the edge portion, wherein reinforcement ribs are formed in the rising portion of the dome portion along the boundary and in the rising portion of the edge portion along the boundary so as to increase the rigidity in the radial direction in the junction portion where a voice coil is attached to the diaphragm, in order to suppress abnormal vibrations of the diaphragm due to the natural resonance of the voice coil, which is hung along the boundary between the dome portion and the edge portion of the diaphragm, thus improving the frequency response. Japanese Laid-Open Patent Publication No. 2006-287418 discloses a loudspeaker aiming at reducing the frequency response disturbance over the high range due to harmonic distortion, increasing the degree of freedom in adjusting the compliance in the edge damper, and ensuring an intended, unvaried compliance across the entire area around the diaphragm. In the loudspeaker, reinforcement ribs, being portions of a rugged structure, are formed along the outer periphery portion of the edge damper body, which is connected integrally with the outer periphery of a dome-shaped diaphragm in order to make uniform the compliance around the diaphragm and to improve the degree of freedom in adjusting the compliance around the diaphragm. In the dome-shaped diaphragm, on the other hand, reinforcement ribs, being grooves or ridges, extend radially with respect to the dome center, i.e., extend from near the dome center portion toward the outer periphery of the dome, in order to improve the rigidity.

International Publication WO2004/047487 discloses an electroacoustic transducer comprising a membrane with a middle area comprising stiffening grooves, wherein a membrane (20) has a membrane axis (5) and a middle area (50), a central cup-shaped depression (52) being provided around said membrane axis (5), which depression (52) preferably has a connecting channel (53), wherein the middle area (50) comprises groups of stiffening grooves (54, 55, 56, 57) which extend parallel to radial directions and of which a first group of long stiffening grooves (54, 55, 56) extends up to the depression (52), said connecting channel (53) issuing into two of the long stiffening grooves (55, 56), thus interconnecting these two long stiffening grooves (55, 56).

However, the conventional loudspeaker diaphragms and loudspeakers may not be sufficient for realizing both a further reduction in the thickness of a loudspeaker suitable for a portable electronic device and a countermeasure against peaks and dips in the frequency response over the high range. For example, when a concave dome-shaped depression is formed in a portion of a generally dome-like shape in order to reduce the overall height dimension of a loudspeaker diaphragm, the boundary between the concave dome-shaped depression and the convex dome-shaped portion acts as a node of a vibration mode to prevent a stable operation, wherein dips occur in the frequency response over the high range, thus failing to realize a desirable sound reproduction.

SUMMARY OF THE INVENTION

A loudspeaker diaphragm of the present invention is a loudspeaker diaphragm being a single-piece film member including a dome portion and an edge portion extending along an outer periphery of the dome portion, wherein: the dome portion includes a concave dome portion formed at a center thereof, a convex dome portion along an outer periphery of the concave dome portion, a plurality of depressed ribs each extending in a radial direction across a boundary between the concave dome portion and the convex dome portion, a voice coil attachment portion along an outer periphery of the convex dome portion, and a plurality of protruding ribs extending in the radial direction across a boundary between the convex dome portion and the voice coil attachment portion; and each protruding rib is spaced apart in a circumferential direction from two adjacent depressed ribs.

Preferably, in the convex dome portion of the dome portion, the depressed ribs and the protruding ribs alternate with each other in the circumferential direction.

More preferably, in the convex dome portion of the dome portion, a first radius value defining a distal end of the depressed ribs is greater than a second radius value defining a proximal end of the protruding ribs.

The loudspeaker diaphragm of the present invention may further include a voice coil attached to the voice coil attachment portion.

A loudspeaker of the present invention includes the loudspeaker diaphragm of the present invention.

Functions of the present invention will now be described.

The loudspeaker diaphragm of the present invention is obtained by molding a film member of a resin such as PEI (polyetherimide) into a shape that is suitable for a small and thin loudspeaker used in a portable telephone, a portable game device, or the like, and is a single-piece diaphragm including a central dome portion and an edge portion extending along the outer periphery of the dome portion. The dome portion is generally protruding in the frontward direction, and accounts for the inside of the area defined by the voice coil attached to the rear surface of the loudspeaker diaphragm. The dome portion is a portion of the loudspeaker diaphragm to which the driving force from the voice coil is transmitted in a desirable manner, and therefore plays a primary roll as part of the diaphragm for radiating a sound wave. The edge portion accounts for the area outside the voice coil, and is corrugated, with the outer periphery thereof being fixed to the frame. The edge portion also functions as part of the diaphragm for radiating a sound wave, while supporting the dome portion so as to allow vibrations thereof.

The dome portion includes the concave dome portion formed at the center thereof, the convex dome portion along the outer periphery of the concave dome portion, and the voice coil attachment portion along the outer periphery of the convex dome portion. Thus, the dome portion includes the convex dome portion having a sufficient rigidity as a loudspeaker diaphragm, and the voice coil attachment portion provided along the outer periphery of the convex dome portion as a flat portion to which the voice coil is attached, wherein the area around the top of the convex dome portion, which most protrudes to thereby define the overall height of the loudspeaker diaphragm, is depressed to form the concave dome portion. Therefore, it is possible to suppress the overall height of the loudspeaker diaphragm to be low, while increasing the rigidity of the dome portion.

The dome portion of the loudspeaker diaphragm of the present invention includes the plurality of depressed ribs each extending in the radial direction across the boundary between the concave dome portion and the convex dome portion, and the plurality of protruding ribs extending in the radial direction across the boundary between the convex dome portion and the voice coil attachment portion. A "depressed rib" as used herein refers to a groove extending in the radial direction while being depressed in the rearward direction as viewed from the front side of the loudspeaker diaphragm. A "protruding rib" as used herein refers to a ridge extending in the radial direction while protruding in the frontward direction, as opposed to a depressed rib. When viewed from the rear side, however, a protruding rib is also a groove, as is a depressed rib, extending in the radial direction while being depressed in the frontward direction. The depressed ribs and the protruding ribs are both formed to extend in the radial direction from the center of the loudspeaker diaphragm for the purpose of increasing the rigidity of the dome portion in the ribbed area.

The plurality of depressed ribs are formed to extend in the radial direction across the boundary between the concave dome portion and the convex dome portion, thus reinforcing the boundary portion between the concave dome portion and the convex dome portion. The plurality of protruding ribs are formed to extend in the radial direction across the boundary between the convex dome portion and the voice coil attachment portion, thus reinforcing the boundary portion between the convex dome portion and the voice coil attachment portion. Each protruding rib is spaced apart in the circumferential direction from two adjacent depressed ribs. Preferably, in the convex dome portion of the dome portion, the depressed ribs and the protruding ribs alternate with each other in the circumferential direction. Thus, not only is the overall rigidity of the convex dome portion reinforced, but also the boundary portion between the convex dome portion and the concave dome portion and the boundary portion between the convex dome portion and the voice coil attachment portion are reinforced. Thus, even though the loudspeaker diaphragm includes the concave dome portion in order to reduce the overall height dimension of the loudspeaker diaphragm, it is possible to suppress divided vibrations of the dome portion of the loudspeaker diaphragm and prevent a dip from occurring in the high range of the frequency response.

Where the first radius value defining the distal end of the depressed ribs is greater than the second radius value defining the proximal end of the protruding ribs, the protruding ribs and the depressed ribs will alternate with each other in the circumferential direction across the convex dome portion at a predetermined distance from the center. Thus, there is provided a reinforcement structure in which the protruding ribs and the depressed ribs overlap with each other around the radially middle portion of the convex dome portion, which is the primary portion of the loudspeaker diaphragm, whereby the rigidity of the dome portion of the loudspeaker diaphragm can be increased in a well-balanced manner. As a result, it is possible to realize a loudspeaker diaphragm capable of a stable operation and a desirable sound reproduction, and to realize a loudspeaker using the same.

The shape of the corrugated edge portion may be any suitable shape as long as it appropriately allows vibrations of the dome portion of the loudspeaker diaphragm and the voice coil, and may be a corrugated shape, a rolled shape, or a conical shape. With the rigidity of the dome portion being increased by ribs extending across the boundary portion, a loudspeaker using the loudspeaker diaphragm of the present invention has a wide reproduction frequency range and is less likely to have problems such as noise even when an input signal of a large amplitude is applied to the voice coil, thereby realizing a desirable sound reproduction.

DETAILED DESCRIPTION OF THE PREFERRED EMBODIMENTS

Preferred embodiments of the present invention will now be described in detail with reference to the drawings. Note that the present invention is not limited to these particular embodiments set forth below.

Embodiment 1

Figure 1:
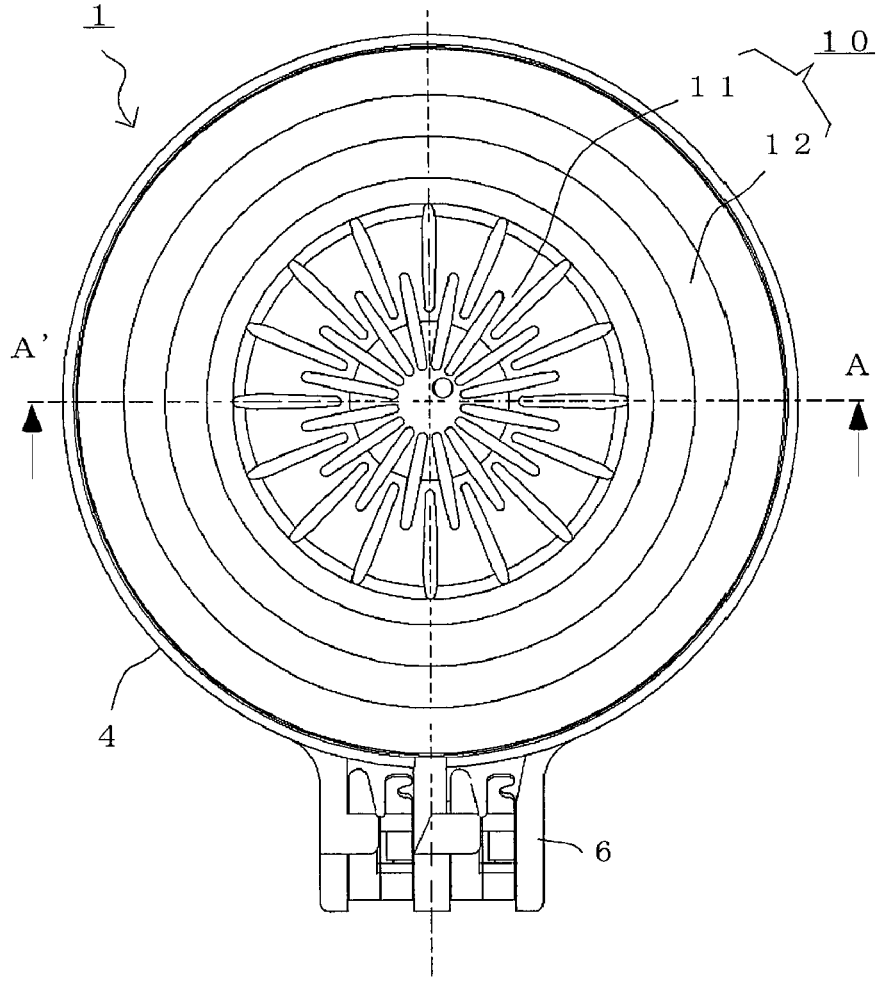
FIGS. 1A and 1B illustrate a loudspeaker 1 using a loudspeaker diaphragm 10.
Figure 1:
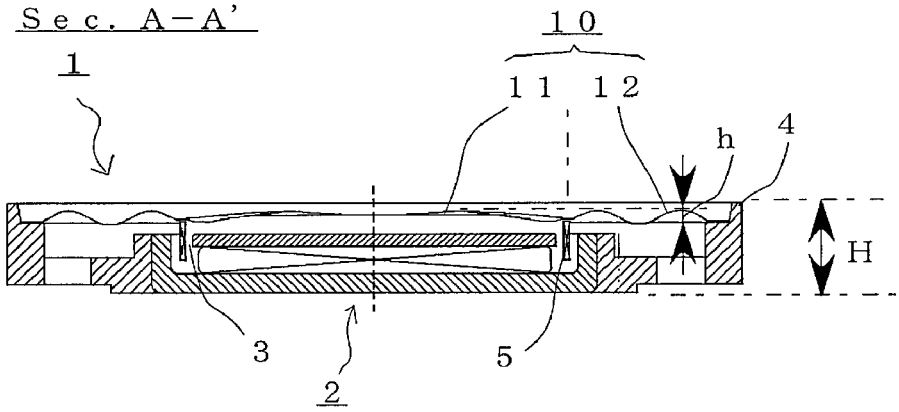

FIGS. 1A and 1B illustrate a loudspeaker 1 using a loudspeaker diaphragm 10 in a preferred embodiment of the present invention. FIG. 1A is a plan view of the loudspeaker 1, and FIG. 1B is a side cross-sectional view thereof taken along line A-A'. The loudspeaker 1 of the present embodiment is a small and thin electrodynamic loudspeaker having a diameter of 20 mm, and includes a light-weighted magnetic circuit 2 of an inner-magnet type, and the loudspeaker diaphragm 10. The loudspeaker diaphragm 10 is obtained by molding a PEI (polyetherimide) resin film member, and is a single-piece member including a dome portion 11 and an edge portion 12.

In addition to the magnetic circuit 2 formed by a pole, a magnet and a yoke and defining a magnetic gap 3 therein, the loudspeaker 1 also includes a frame 4 attached to the magnetic circuit 2 for supporting the loudspeaker diaphragm 10 so as to allow vibrations of the loudspeaker diaphragm 10, and a voice coil 5 attached to the rear surface of the loudspeaker diaphragm 10 and disposed in the magnetic gap 3. The frame 4 includes a terminal 6 via which an audio signal current is supplied to the voice coil 5. The lead wire connecting the voice coil 5 and the terminal 6 to each other is not shown in FIGS. 1A and 1B.

The front side of the loudspeaker 1 is defined herein to be the side on which the loudspeaker diaphragm 10 is exposed, and the rear side thereof is defined herein to be the side on which the magnetic circuit 2 is exposed. The overall height of the loudspeaker 1 is influenced by the height of the magnetic circuit 2 and that of the loudspeaker diaphragm 10. The frame 4 includes a rim portion, along the outer periphery thereof, protruding farthest in the frontward direction for protecting the loudspeaker diaphragm 10. The overall height dimension H of the loudspeaker 1 is defined by the rim portion of the frame 4 and a portion of the magnetic circuit 2 that is protruding farthest in the rearward direction. In the present embodiment, the loudspeaker diaphragm 10 has a reduced overall height h (about 0.65 mm), thereby reducing the overall height dimension H of the loudspeaker 1 to only 2.8 mm. The voice coil 5 is bonded on the rear surface of the loudspeaker diaphragm 10 by an adhesive.

In the loudspeaker 1, the voice coil 5 is disposed in the magnetic gap 3 where there is a strong DC magnetic field. An audio signal current supplied to the voice coil 5 generates a driving force in the front-rear direction of the loudspeaker diaphragm 10, whereby the loudspeaker vibration system including the voice coil 5 and the loudspeaker diaphragm 10 vibrates in the front-rear direction. Specifically, the loudspeaker vibration system is supported only by the edge 12 of the loudspeaker diaphragm 10 so as to allow vibrations thereof, thereby creating variations in the pressure of the air existing on the front and rear side of the loudspeaker diaphragm 10. Thus, an audio signal current is converted to a sound wave (sound).

Figure 2:
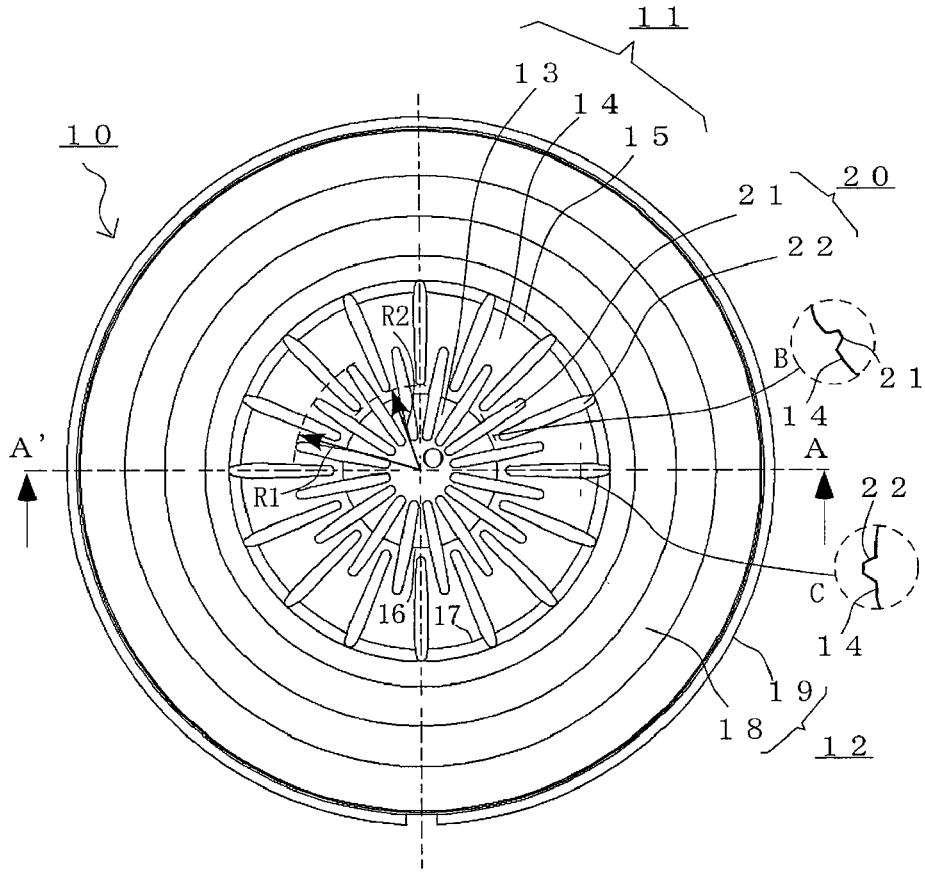
FIGS. 2A and 2B illustrate the loudspeaker diaphragm 10.
Figure 2:
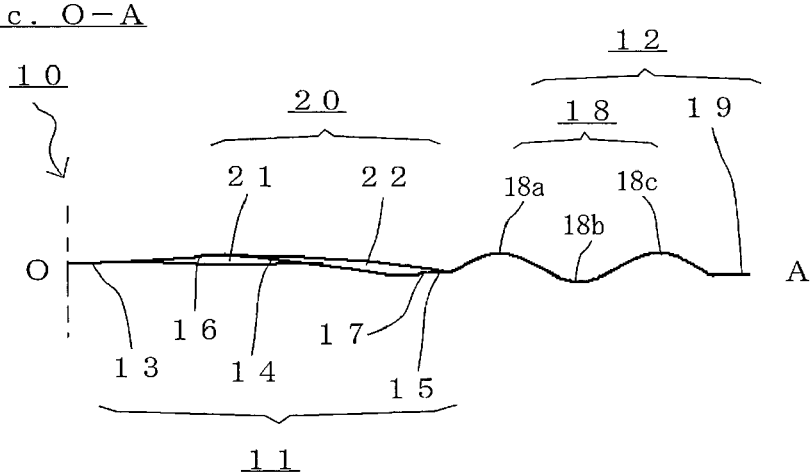

FIGS. 2A and 2B illustrate the loudspeaker diaphragm 10, wherein FIG. 2A is a plan view thereof, and FIG. 2B is a side cross-sectional view thereof taken along line O-A. The loudspeaker diaphragm 10 is a single-piece dome-edge diaphragm obtained by press-molding a PEI (polyetherimide) resin film member having a thickness of 30 μm. Thus, the loudspeaker diaphragm 10 is a loudspeaker diaphragm obtained by forming, as a single-piece member, the generally dome-shaped dome portion 11 having a low profile and the edge portion 12 extending along the outer periphery of the dome portion 11. The external diameter of the loudspeaker diaphragm 10 is about 22 mm.

The dome portion 11 is a portion of the loudspeaker diaphragm 10 that is inside the circular area defined by the voice coil 5, which is attached to the rear surface of the loudspeaker diaphragm 10, and is a portion that is generally protruding in the frontward direction. The dome portion 11 includes a concave dome portion 13 at the center of the dome portion 11, a convex dome portion 14 extending along the outer periphery of the concave dome portion 13, and a voice coil attachment portion 15 extending along the outer periphery of the convex dome portion 14. The concave dome portion 13 is obtained by depressing a central top portion of the convex dome portion 14, which is protruding in the frontward direction from the voice coil attachment portion 15, so as to give a sufficient rigidity to the loudspeaker diaphragm 10. Therefore, the portion of the loudspeaker diaphragm 10 most protruding in the frontward direction, which defines the overall height h thereof, is the boundary portion between the concave dome portion 13 and the convex dome portion 14. In other words, the boundary portion between the concave dome portion 13 and the convex dome portion 14 is a portion that is generally protruding in the frontward direction and includes a ridge line 16 representing the boundary. The external diameter of the concave dome portion 13 is 5.0 mm, and that of the convex dome portion 14 is 11.6 mm.

The voice coil attachment portion 15 is a narrow flat portion having a radial width of about 0.4 mm along the outer periphery of the convex dome portion 14, along which the voice coil 5 is attached to the loudspeaker diaphragm 10. The boundary portion between the convex dome portion 14 and the voice coil attachment portion 15 is where the convex dome portion 14 rises from the voice coil attachment portion 15, and includes a valley line 17 representing the boundary.

The edge portion 12 is a portion of the loudspeaker diaphragm 10 that is outside the circular area defined by the voice coil 5. The edge portion 12 supports the dome portion 11 so as to allow vibrations thereof, while the edge portion 12 includes corrugations 18 and serves also as a diaphragm for radiating a sound wave. The corrugations 18 includes a convex roll 18*a* that is connected to the voice coil attachment portion 15 along the inner periphery thereof, a concave roll 18*b* connected to the convex roll 18*a*, and a convex roll 18*c* connected to the concave roll 18*b*. The corrugations 18 have an internal diameter of 12.4 mm, and an external diameter of 21 mm. Provided along the outer periphery of the edge portion 12 is a flat portion 19 fixed to the frame 4, and the flat portion 19 is a reference with respect to which the overall height h of the loudspeaker diaphragm 10 is defined. Thus, in the present embodiment, the overall height h of the loudspeaker diaphragm 10 is about 0.65 mm.

The dome portion 11 of the loudspeaker diaphragm 10 includes ribs 20 for increasing the rigidity of the dome portion 11. The dome portion 11 includes the concave dome portion 13, the convex dome portion 14 and the voice coil attachment portion 15 each having a different configuration and being continuous with one another, wherein each point of inflection on the cross section thereof represents a boundary portion therebetween and forms the ridge line 16 or the valley line 17 described above as viewed from above. Where the boundary portion including the ridge line 16 and the valley line 17 is not sufficiently rigid, the boundary portion along which the configuration changes between the concave dome portion 13, the convex dome portion 14 and the voice coil attachment portion 15 may become a node of a vibration mode, whereby divided vibrations become pronounced and a dip occurs in the high range of the frequency response, thus failing to realize a desirable sound reproduction. In view of this, the ribs 20 are formed in order to increase the rigidity of the boundary portion of the dome portion 11. The loudspeaker diaphragm 10 of the present embodiment includes 16 depressed ribs 21 extending in the radial direction across the boundary portion including the ridge line 16 between the concave dome portion 13 and the convex dome portion 14 of the dome portion 11. The loudspeaker diaphragm 10 of the present embodiment also includes 16 protruding ribs 22 extending in the radial direction across the boundary portion including the valley line 17 between the convex dome portion 14 and the voice coil attachment portion 15 of the dome portion 11.

Each of the depressed ribs 21 is a radially-extending groove having a width of about 0.4 mm that is depressed in the rearward direction as viewed from the front side of the loudspeaker diaphragm 10, and extends in the radial direction from an intermediate portion of the concave dome portion 13 to an intermediate portion of the convex dome portion 14. The radius r1 defining the proximal end of the depressed ribs 21 is about 1.0 mm, and the first radius R1 defining the distal end thereof is about 4.1 mm. While the depth of the depressed ribs 21 varies depending on the shape of the concave dome portion 13 and that of the convex dome portion 14, the maximum depth is about 0.2 mm. The 16 depressed ribs 21 radially extend around the center O while being arranged equidistantly with respect to one another in the circumferential direction. Thus, the depressed ribs 21 are obtained by depressing a plurality of portions of the generally-convex ridge line 16, thereby increasing the rigidity of the boundary portion between the concave dome portion 13 and the convex dome portion 14.

Each of the protruding ribs 22 is a radially-extending ridge having a width of about 0.45 mm that is protruding in the frontward direction as viewed from the front side of the loudspeaker diaphragm 10 (as opposed to the depressed ribs 21), and extends in the radial direction from the convex dome portion 14 to the voice coil attachment portion 15. When viewed from the rear side of the loudspeaker diaphragm 10, however, the protruding ribs 22 are also grooves, as are the depressed ribs 21. While the height of the ridge (the depth of the groove) varies depending on the shape of the convex dome portion 14 and that of the voice coil attachment portion 15, the maximum height (depth) is about 0.2 mm. The second radius R2 defining the proximal end of the protruding ribs 22 is about 2.8 mm, and the radius r2 defining the distal end thereof is about 5.8 mm, i.e., equal to the external diameter of the voice coil attachment portion 15. The 16 protruding ribs 22 also radially extend around the center O while being arranged equidistantly with respect to one another in the circumferential direction. Thus, the protruding ribs 22 are obtained by protruding a plurality of portions of the valley line 17, along which the convex dome portion 14 rises, thereby increasing the rigidity of the boundary portion between the convex dome portion 14 and the voice coil attachment portion 15.

As shown in FIGS. 1A to 2B, the depressed ribs 21 and the protruding ribs 22 of the loudspeaker diaphragm 10 are shifted in the circumferential direction from each other by an angle of 11.25° with respect to the center O, and therefore do not have an overlap with each other. In other words, in the convex dome portion 14 of the dome portion 11, the depressed ribs 21 and the protruding ribs 22 alternate with each other in the circumferential direction, with each protruding rib 22 being spaced apart in the circumferential direction from two adjacent depressed ribs 21. Such an arrangement is realized in the present embodiment because the first radius R1 (about 4.1 mm) defining the distal end of the depressed ribs 21 is set to be greater than the second radius R2 (about 2.8 mm) defining the proximal end of the protruding ribs 22.

Since the dome portion 11 of the loudspeaker diaphragm 10 of the present embodiment has a reinforcement structure in which the depressed ribs 21 and the protruding ribs 22 overlap with each other only in the radial direction and are spaced apart from each other in the circumferential direction, it is possible to increase the rigidity of the dome portion 11 in a well-balanced manner. Not only is the overall rigidity of the convex dome portion 14 increased, but also the boundary portion between the convex dome portion 14 and the concave dome portion 13 and the boundary portion between the convex dome portion 14 and the voice coil attachment portion 15 are reinforced. Thus, even though the loudspeaker diaphragm 10 includes the concave dome portion 13 in order to reduce the overall height dimension of the dome portion 11, it is possible to suppress divided vibrations of the loudspeaker diaphragm 10 and prevent a dip from occurring in the high range of the frequency response.

Figure 3:
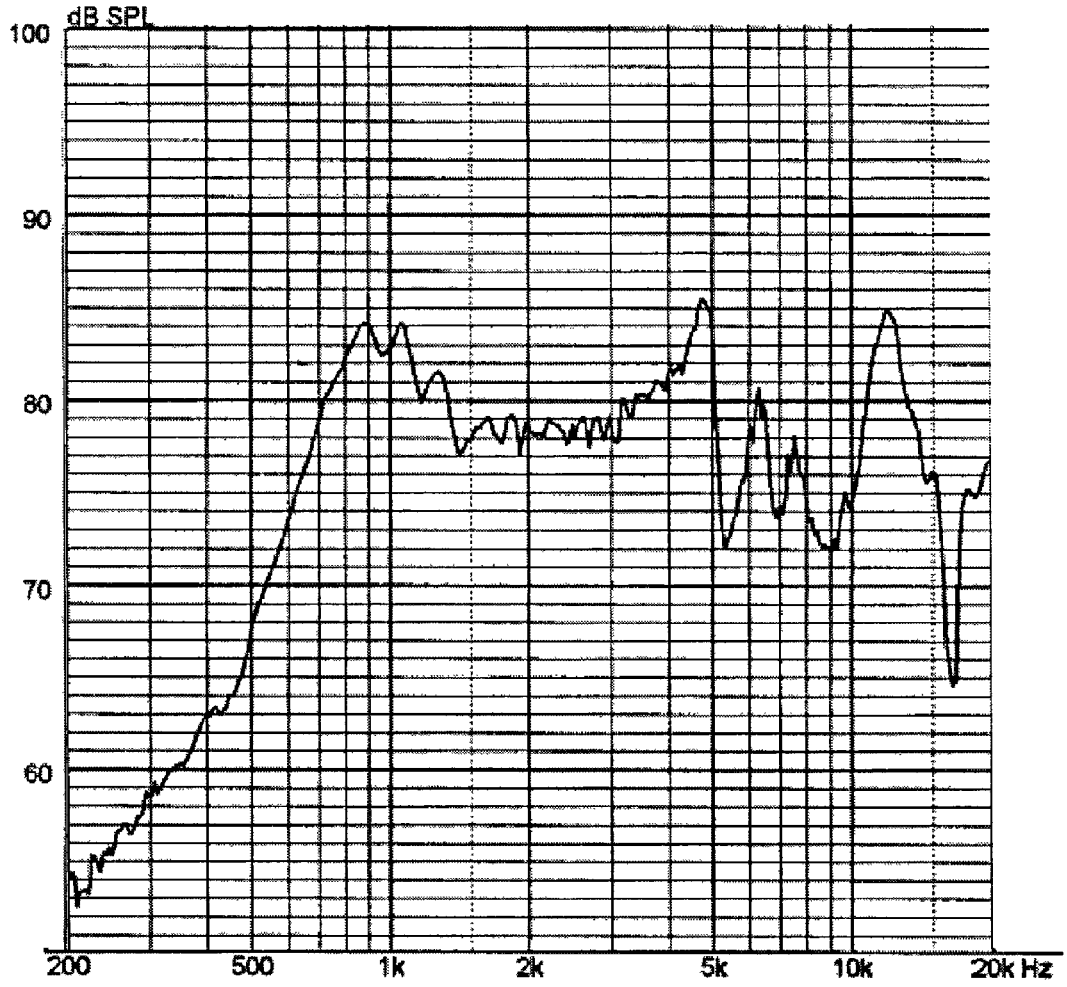
FIG. 3 is a graph showing the frequency response of the loudspeaker 1.

FIG. 3 is a graph showing the frequency response (calculated at 1 m on axis for 1 W input) of the loudspeaker 1 including the loudspeaker diaphragm 10 of the present embodiment. The horizontal axis represents the frequency ("Frequency" in Hz) of the sound signal, and the vertical axis represents the sound pressure level ("SPL" in dB). It can be seen that there is obtained a wide reproduction frequency range from the lowest resonance frequency f0, being about 850 Hz, to about 5 kHz. With the rigidity of the dome portion 11 being increased in a well-balanced manner, no significant dips are observed, except for a peak at around 4.8 kHz and a dip at around 5.2 kHz, and the frequency response is relatively flat being continuous with the peak at around 6.3 kHz due to the divided vibrations of the edge portion. With a rated input of 0.1 W, the loudspeaker 1 of the present embodiment realizes a desirable sound reproduction without noise, or the like.

Figure 4:
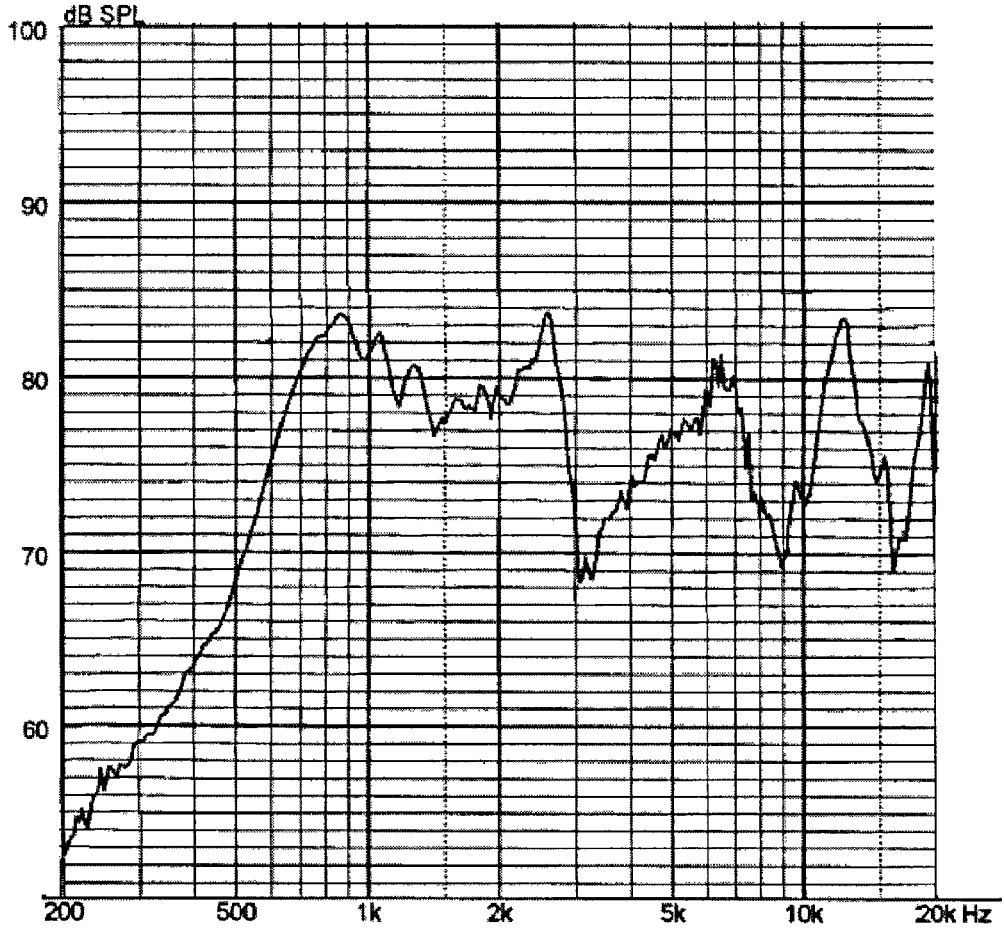
FIG. 4 is a graph showing the frequency response of a loudspeaker using a reference loudspeaker diaphragm.

FIG. 4 is a graph showing the frequency response (calculated at 1 m on axis for 1 W input) of a reference loudspeaker (not shown) using a conventional loudspeaker diaphragm (not shown). The reference loudspeaker is a small electrodynamic loudspeaker including a loudspeaker diaphragm having the same diameter as that of the loudspeaker 1 of Embodiment 1, wherein the shape of the dome portion and that of the edge portion are basically the same as those of the dome portion 11 and the edge portion 12 of the loudspeaker 1 of Embodiment 1. Although the reference loudspeaker diaphragm includes the concave dome portion formed at the center for increasing the rigidity of the dome portion, there are not provided the ribs 20 (the depressed ribs 21 and the protruding ribs 22) of Embodiment 1 extending in the radial direction for increasing the rigidity of the boundary portions of the dome portion.

Although the reference loudspeaker has a frequency response similar to that of the embodiment above, significant peaks and dips are observed over the range from about 2 kHz to about 5 kHz because the rigidity of the dome portion of the loudspeaker diaphragm is insufficient, thus resulting in a disturbed frequency response. Specifically, there is a peak at around 2.5 kHz and a dip at around 3.1 kHz, and there is observed a significant dip between 3.1 kHz and the peak at around 6.3 kHz due to the divided vibrations of the edge portion. Thus, even with the concave dome portion formed in the generally dome-like shape in order to reduce the overall height dimension of the reference loudspeaker diaphragm, the rigidity of the boundary portion including the ridge line between the concave dome portion and the convex dome portion is insufficient, and the boundary portion therefore becomes a node of a vibration mode, whereby the concave dome portion and the convex dome portion vibrate in antiphase with respect to each other. This problem similarly occurs also with the boundary portion including the valley line between the convex dome portion and the voice coil attachment portion. Therefore, with the reference loudspeaker diaphragm, it is not possible to realize a stable operation of the loudspeaker, and it is not possible to realize a desirable sound reproduction, with a dip occurring in the high range of the frequency response. With a rated input of 0.1 W, the reference loudspeaker fails to realize a stable operation and produces noise, as compared with the loudspeaker 1 of the embodiment above, which is more capable of realizing a desirable sound reproduction.

The loudspeaker 1 of the present invention is not limited to that of the embodiment above, but the present invention is also applicable to, for example, a large-sized electrodynamic loudspeaker having a large diameter with a separately-provided damper, as long as the loudspeaker diaphragm 10 is a single-piece film member including the dome portion 11 and the edge portion 12 extending along the outer periphery of the dome portion 11. When the dome portion 11 of the loudspeaker diaphragm 10 includes the concave dome portion 13 formed at the center, the depressed ribs 21 and the protruding ribs 22 can be provided in order to reinforce the boundary portion of the dome portion 11. The depressed ribs 21 and the protruding ribs 22 may be arranged so that each protruding rib 22 is spaced apart in the circumferential direction from two adjacent depressed ribs 21, or so that the depressed ribs 21 and the protruding ribs 22 alternate with each other in the circumferential direction. By increasing the rigidity of the convex dome portion 14 of the dome portion 11 of the loudspeaker diaphragm 10, it is possible to provide a loudspeaker capable of realizing a desirable sound reproduction with few peaks and dips.

The loudspeaker diaphragm 10 of the present invention is not limited to that of the embodiment above, and may include the ribs 20 (i.e., the depressed ribs 21 and the protruding ribs 22) with different arrangement patterns or with different cross sections. Specifically, the depressed rib 21 or the protruding rib 22 is not limited to a straight groove or a straight ridge, but may be curved into a spiral shape extending in the circumferential direction. Such curved ribs may be used, as long as each protruding rib 22 is spaced apart from two adjacent depressed ribs 21.

In Embodiment 1 above, the corrugations 18 of the edge portion 12 have a curved wave-like cross section with the height of a portion thereof that is most protruding in the frontward direction being less than the overall height of the dome portion 11, but the present invention is not limited thereto. The height of the portion of the corrugations 18 of the edge portion 12 that is most protruding in the frontward direction may be equal to or greater than the overall height of the dome portion 11. In other embodiments, the corrugations 18 may be in a wave-like shape including a plurality of rolls of a small radius continuous with one another, or may be in the form of a single large roll. The loudspeaker 1 using the loudspeaker diaphragm 10 of the present invention has a wide reproduction frequency range and is less likely to have problems such as noise even when an input signal of a large amplitude is applied to the voice coil 5, thereby realizing a desirable sound reproduction.

The resin material of the loudspeaker diaphragm 10 of the present invention is not limited to a PEI film member as illustrated in the embodiment above. For example, the material of the loudspeaker diaphragm 10 may be a light resin film of PET (polyethylene terephthalate), PEN (polyethylene naphthalate), PC (polycarbonate), PI (polyimide), PAR (polyarylate), PPS (polyphenylene sulfide), or the like, a material obtained by heat-pressing a sheet, or a material obtained by press-molding an elastomer sheet.

The loudspeaker diaphragm and the loudspeaker of the present invention are not limited to those illustrated in the embodiment above. The magnetic circuit is not limited to a magnetic circuit of the inner-magnet type illustrated in the embodiment above, and may be a magnetic circuit of the outer-magnet type or a repulsive magnetic circuit. Moreover, the loudspeaker diaphragm is not limited to a circular-shape diaphragm, but may be a conical diaphragm of an elliptical shape or a racetrack shape.

The loudspeaker diaphragm of the present invention is applicable not only to a loudspeaker used in a portable electronic device such as a portable telephone or a portable game device, but also to a loudspeaker used in a household stereo system or a multi-channel surround system, or to a loudspeaker used in on-vehicle audio equipment.

What is claimed is:

1. A loudspeaker diaphragm being a single-piece film member including a dome portion and an edge portion extending along an outer periphery of the dome portion, wherein:

the dome portion includes a concave dome portion formed at a center thereof, a convex dome portion along an outer periphery of the concave dome portion, a plurality of depressed ribs each extending in a radial direction across a boundary between the concave dome portion and the convex dome portion, a voice coil attachment portion along an outer periphery of the convex dome portion, and a plurality of protruding ribs extending in the radial direction across a boundary between the convex dome portion and the voice coil attachment portion; and each protruding rib is spaced apart in a circumferential direction from two adjacent depressed ribs.

2. The loudspeaker diaphragm according to claim 1, wherein in the convex dome portion of the dome portion, the depressed ribs and the protruding ribs alternate with each other in the circumferential direction.

3. The loudspeaker diaphragm according to claim 2, wherein in the convex dome portion of the dome portion, a first radius value defining a distal end of the depressed ribs is greater than a second radius value defining a proximal end of the protruding ribs.

4. The loudspeaker diaphragm according to claim 3, further comprising a voice coil attached to the voice coil attachment portion.

5. A loudspeaker, comprising the loudspeaker diaphragm according to claim 4.

* * * * *